US011771950B2

(12) United States Patent
Rose

(10) Patent No.: US 11,771,950 B2
(45) Date of Patent: Oct. 3, 2023

(54) FULL BODY AEROBIC EXERCISE MACHINE

(71) Applicant: Greogry H. Rose, Littleton, CO (US)

(72) Inventor: Greogry H. Rose, Littleton, CO (US)

( * ) Notice: Subject to any disclaimer, the term of this patent is extended or adjusted under 35 U.S.C. 154(b) by 0 days.

(21) Appl. No.: 17/545,900

(22) Filed: Dec. 8, 2021

(65) Prior Publication Data

US 2023/0173337 A1 Jun. 8, 2023

(51) Int. Cl.
*A63B 22/06* (2006.01)
*A63B 23/04* (2006.01)

(52) U.S. Cl.
CPC ..... *A63B 22/0664* (2013.01); *A63B 23/0423* (2013.01); *A63B 2022/0676* (2013.01)

(58) Field of Classification Search
CPC ..... A63B 23/035–0494; A63B 22/00–0069
See application file for complete search history.

(56) References Cited

U.S. PATENT DOCUMENTS 6,206,804 B1 * 3/2001 Maresh ..... A63B 22/0017 482/52
6,454,682 B1 * 9/2002 Kuo ..... A63B 22/0664 482/52
6,620,079 B2 * 9/2003 Kuo ..... A63B 22/001 482/52
7,041,036 B1 * 5/2006 Kuo ..... A63B 22/001 482/52
7,201,706 B1 * 4/2007 Lee ..... A63B 22/0664 482/52
7,682,288 B1 * 3/2010 Stearns ..... A63B 22/0664 482/52
9,610,475 B1 * 4/2017 DeKnock ..... A63B 23/03591
9,764,187 B1 * 9/2017 Stearns ..... A63B 22/06
2002/0094914 A1 * 7/2002 Maresh ..... A63B 22/0017 482/52
2007/0087907 A1 * 4/2007 Rodgers, Jr. ..... A63B 22/001 482/52
2009/0111663 A1 * 4/2009 Kuo ..... A63B 22/001 482/53
2015/0352402 A1 * 12/2015 Arnold ..... A63B 22/0007 482/57

* cited by examiner

*Primary Examiner* — Nyca T Nguyen
(74) *Attorney, Agent, or Firm* — Gregory Perrone; Bobby W. Braxton; Braxton Perrone, PLLC

(57) ABSTRACT

An exercise apparatus orienting foot pedals and handlebars having first and second rotating armatures for generating subtended paths of rotation, with motors to revolve the first and second rotating armatures in opposite directions and allowing the subtended paths to migrate from a first two-dimensional plane into a second two dimensional plane and back into the first two-dimensional plane.

7 Claims, 10 Drawing Sheets

FULL BODY AEROBIC EXERCISE MACHINE

FIELD OF THE DISCLOSURE

The claimed subject matter relates to the expansion of functionality of classic elliptical exercise trainers. While traditional elliptical trainers move solely in a plane parallel to a usual stride, this device slowly revolves about an axis from the usual parallel plane, through a perpendicular plane, and back to parallel. More so, while classic elliptical trainers create a symmetric elliptical path, this device creates a more natural, one-sided flattened elliptical path better simulating natural foot motion. Concurrently, unlike classic elliptical handlebars, the claimed subject matter describes handlebars moving out of phase with the revolving foot pedals in perpendicular and parallel planes instead of one plane.

BACKGROUND

Statistics on American health and exercise indicate that only about twenty-three percent (23%) of American adults meet leisure-time physical activity (LTPA) guidelines, according to research data from the Center for Disease Control's (CDC) National Center for Health Statistics. (National Health Statistics Reports Number 112 v. Jun. 28, 2018). The U.S. Department of Health and Human Services recommends that adults between the ages of eighteen and sixty-four (18-64) engage in at least one hundred fifty (150) minutes of moderate physical activity or seventy-five (75) minutes of vigorous physical activity every week. As health is a growing issue for adults and of financial concern for insurance companies, we seek to find ways to lower barriers to allow people to exercise more frequently, effectively, vigorously, and safely.

It is well documented that regular aerobic exercise is important and recommended for all able-bodied people. Regular exercise can fend off heart disease and improve circulation. It helps prevent type 2 diabetes as muscles stay more receptive to insulin. It has been suggested it can lower the risk of cancer: colon, breast, endometrial, and maybe ovarian. It has also been shown to reduce the risk of recurrence of colon and breast cancer. Symptoms of depression can be reduced with exercise and perhaps delay the onset of cognitive decline into dementia.

Running and other aerobic exercise can negatively impact the joints. There has been a positive trend in exercise choice moving from running on treadmills causing joint damage to non-impactful stepping on elliptical machines. However, exercising on an elliptical trainer without significant variability in the motion path can overwork a particular group of muscles while neglecting others. Our apparatus allows a smooth, continuous change in the motion pathways allowing continuous change in the muscle groups exercised. Elliptical trainers can reduce the damaging effects of impact exercises but should allow for variability. Most adults seek exercise that is as quick and effective as possible. Elliptical trainers exercise a limited group of muscles and offer limited core muscle group exercise. While some elliptical machines provide the ability to change the size of the ellipse, they do not substantially allow modification of the shape of the ellipse nor allow it to move in a different plane.

The claimed subject matter relates a novel method and apparatus for facilitating whole body aerobic exercise in a more complete and natural fashion.

There are numerous reasons why most adults don't regularly exercise. These include boredom, working with multiple machines, excessive time, and not getting results. This claimed subject matter addresses each of these reasons.

Running on a treadmill or working out on a classic elliptical machine can be monotonous. Our apparatus breaks up the monotony by allow a constantly evolving path for the legs and arms.

While elliptical trainers provide a low impact workout, they are limited to working a fixed group of muscles viz. the anterior and posterior aspects of the legs and hips. They largely neglect the important lateral and medial stabilizing muscles of the legs used in sports to improve performance and mitigate against injury. Without strength in the stabilizing lateral and medial muscles of the legs, but strength in the anterior and posterior muscles, the user may think he has plenty of strength to perform a particular move but fail and possibly injure himself due to lack of stabilizing muscles. The same is true of the traditional upper body handlebars on classic elliptical exercisers that only work a limited muscle group. The present claimed subject matter provides a greater range of motion for the arms and torso.

A similar embodiment to include orienting the foot pedals and handlebars to allow for a seated recumbent arrangement is claimed.

Treadmills have been around since the Roman empire employed them to accomplish various work tasks powered by men. For centuries, animals were put on treadmills for the same purpose. Treadmills were used in prisons as punishment until the practice was outlawed in the $19^{th}$ century. Cardiologists discovered the usefulness of treadmills in diagnosing cardiac disease in the 1950's. Classic treadmills began populating gyms in the 1960's and 1970's and have become a familiar fixture. Modern treadmills continue to improve various elements of the experience but remain an impact exercise.

Over time, evidence has mounted regarding the negative effects of impact exercise inspiring exploration of other methods of achieving a satisfactory, aerobic workout leading to the invention of the elliptical exerciser in the 1990's. It, too, has evolved over the years and similarly remains a fixture in modern gyms next to the treadmills.

BRIEF DESCRIPTION OF THE DRAWINGS

The novel features believed characteristic of the invention are set forth in the appended claims. The invention itself, however, as well as a preferred mode of use, further objectives, and advantages thereof, will be best understood by reference to the following detailed description of illustrative embodiments when read in conjunction with the accompanying drawings, wherein:

DETAILED DESCRIPTIONS OF THE DRAWINGS

Before undertaking the detailed description below, it may be advantageous to set forth definitions of certain words and phrases used in connection to the disclosed exemplary embodiments: the terms "include" and "comprise," as well as derivatives thereof, mean inclusion without limitation; the term "or" is inclusive, meaning and/or; the phrases "associated with" and "associated therewith," as well as derivatives thereof, may mean to include, be included within, interconnect with, contain, be contained within, connect to or with, couple to or with, be communicable with, cooperate with, interleave, juxtapose, be proximate to, be bound to or with, have, have a property of, or the like.

Although the subject matter of this application has been described with reference to illustrative embodiments, this description is not intended to be construed in a limiting sense. Various modifications and combinations of the illustrative embodiments as well as other embodiments will be apparent to persons skilled in the art upon reference to the description. It is, therefore, intended that the appended claims encompass any such modifications or embodiments. The general processes and systems described herein may be modified heavily depending on a number of factors, with rearrangement and/or addition/deletion of steps anticipated by the scope of the present disclosure. Integration of this and other preferred exemplary embodiment methods in conjunction with a variety of preferred exemplary embodiment systems described herein is anticipated by the overall scope of the presently disclosed system.

Figure 1:
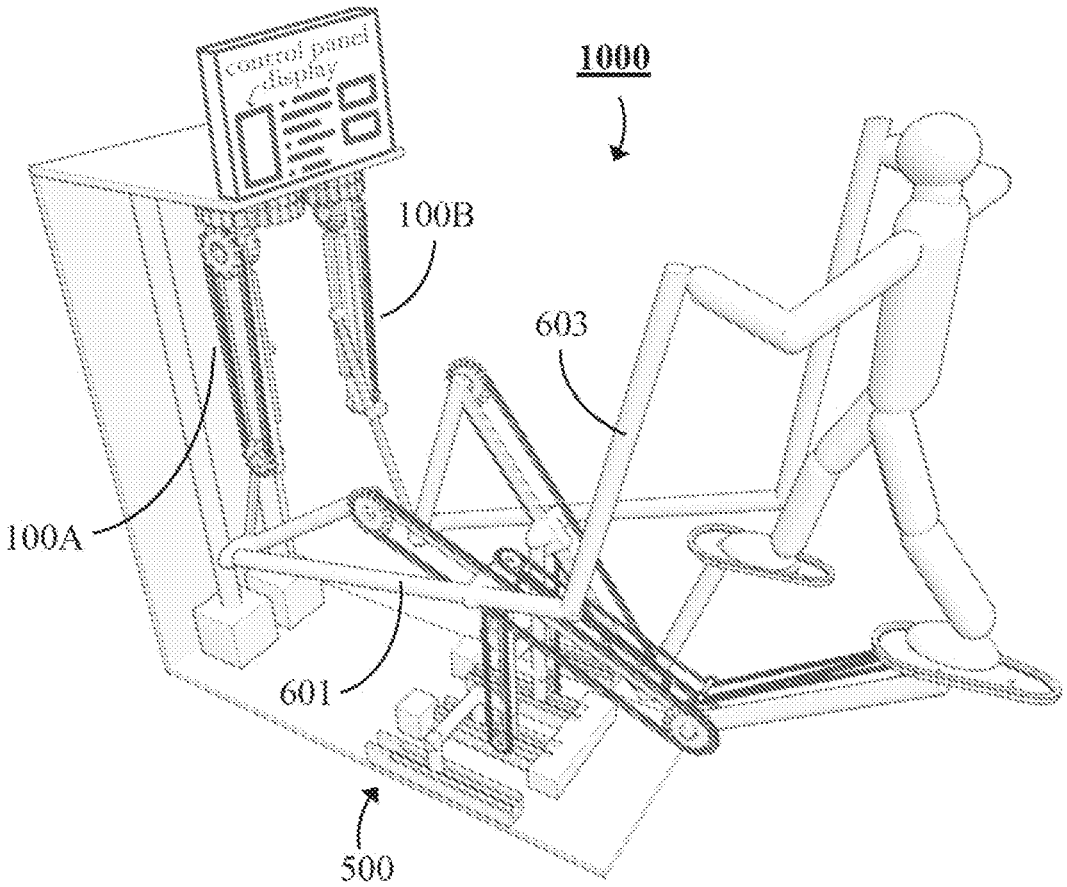
FIG. 1 is a perspective view of a path generator according to an embodiment of the present invention.
Figure 2:
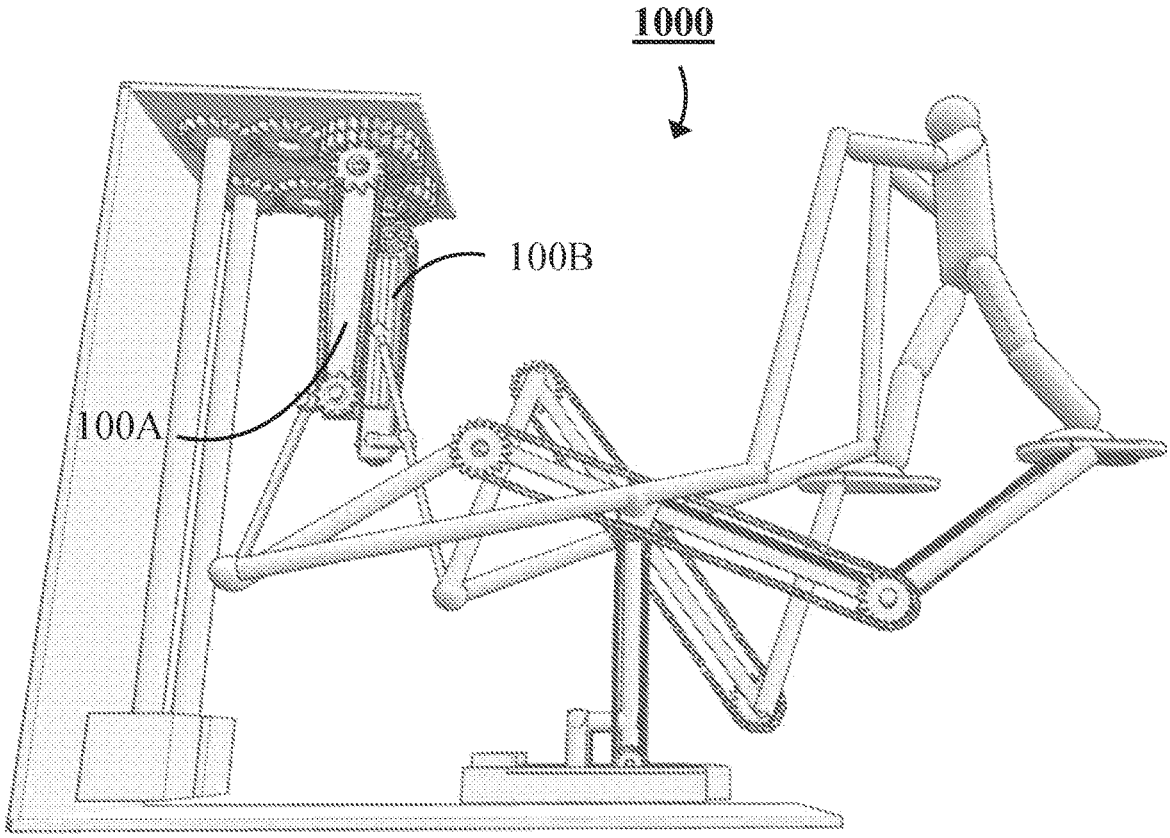
FIG. 2 is a perspective view of a path generator according to an embodiment of the present invention.
Figure 7:
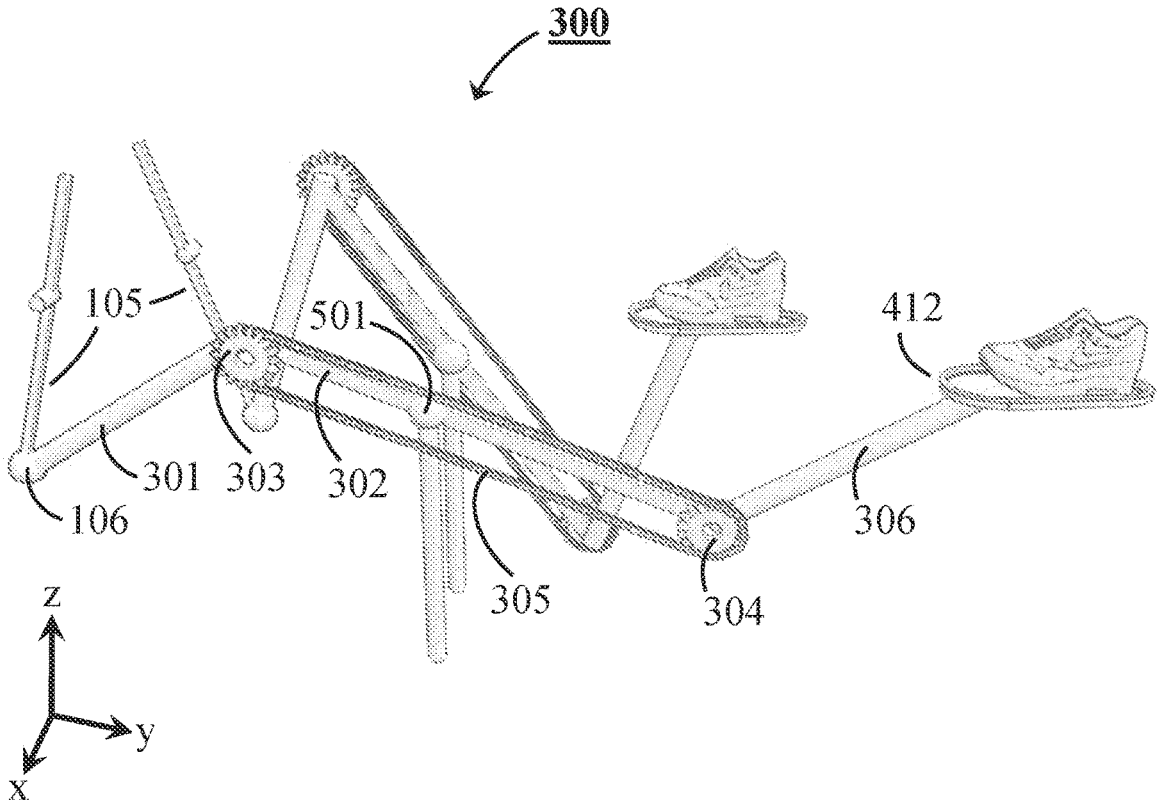
FIG. 7 is a diagram of a rectifying armature mechanism according to an embodiment of the invention.

FIG. 1 and FIG. 2 offer perspective views of rotating and revolving primary path generator 1000 according to an embodiment of the invention. Various components of rotating and revolving primary path generator 1000 include a first core armature assembly 100A and a second core armature assembly 100B, proximal arm 601 and distal arm 603. One proximal arm 601 is in communication with first core armature assembly 100A through the user's motion transferred through a series of rectifier armatures as depicted in FIG. 7. Another proximal arm 601 is in communication with second core armature assembly 100B through the user's motion transferred through a series of rectifier armatures as depicted in FIG. 7. The user's motion is realized by the apparatus via stepping or pedaling type motion taken by the user through pedals 412.

Figure 3:
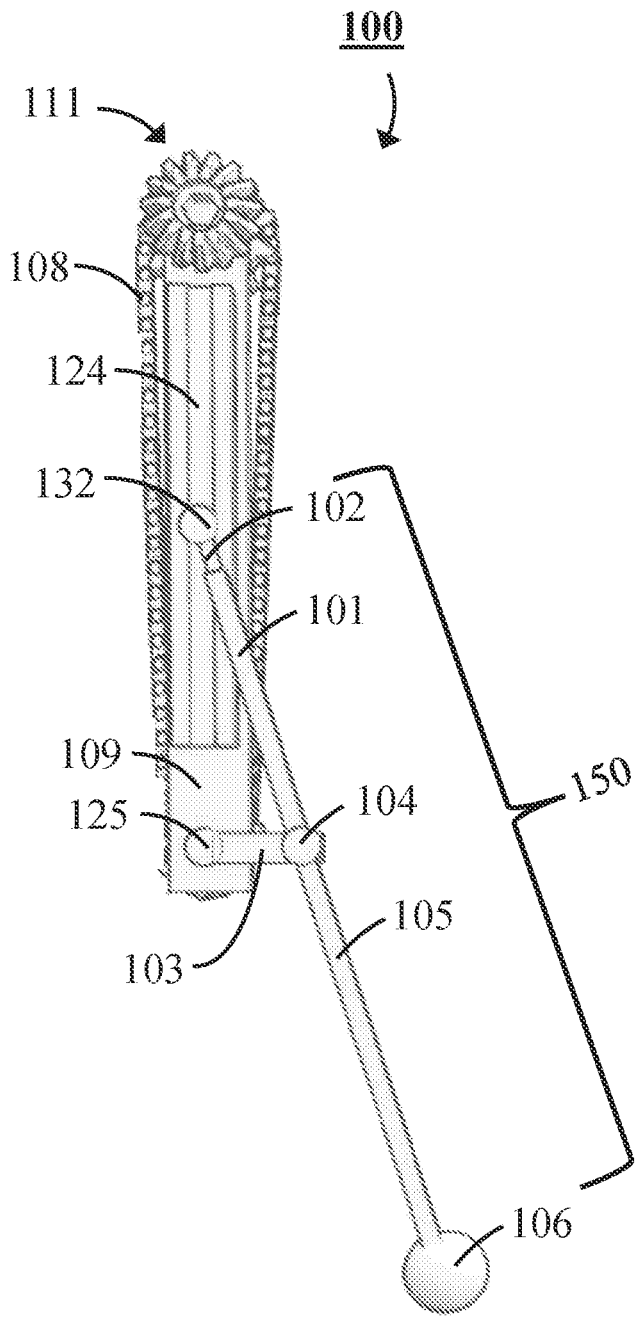
FIG. 3 is a lateral view of a core mechanism of a path generator according to an embodiment of the present invention.

FIG. 3 depicts a core armature assembly of a primary path generator according to an embodiment of the present invention. Core armature assembly 100 generates a motion path according to positions of various positions of first armature 101, second armature 102 and third armature 105. In one embodiment, second armature 102 is sized to telescope or be slidingly engaged inside first armature 101, with the diameter of first armature 101 greater than the diameter of the second armature 102. Armatures 101 and 105 are fixed in length with the exposed length of armature 102 determined by the user to adjust the path subtended by disposed ball joint 106. First, second, and third armatures 101, 102, and 105 are attached at fixed pivot point, 104. Fourth armature, 103, rotating about the axis of rotatable shaft 125 causes rotation of fixed pivot point 104 through a 360 degree cycle. Armature 102 allows adjustment of the length of 101. Variable length rigid bar 150 is a variable length bar formed by the assembly of first armature 101, second armature 102, and third armature 105 and fixes superiorly at an approximate end to upper ball end 132 that is slidingly engaged in first groove 124. The longer second armature 102 is adjusted by extension outward from first armature 101, the more circular the path subtended rather than flattened on one side. At each end of core armature assembly 100 are cogs 111, which will be discussed. As will be discussed, the cog 111 and chain 108 arrangement of core armature assembly 100 is mounted on beam 109. At the distal end of variable length rigid bar 150 is a disposed ball joint 106.

Figure 4:
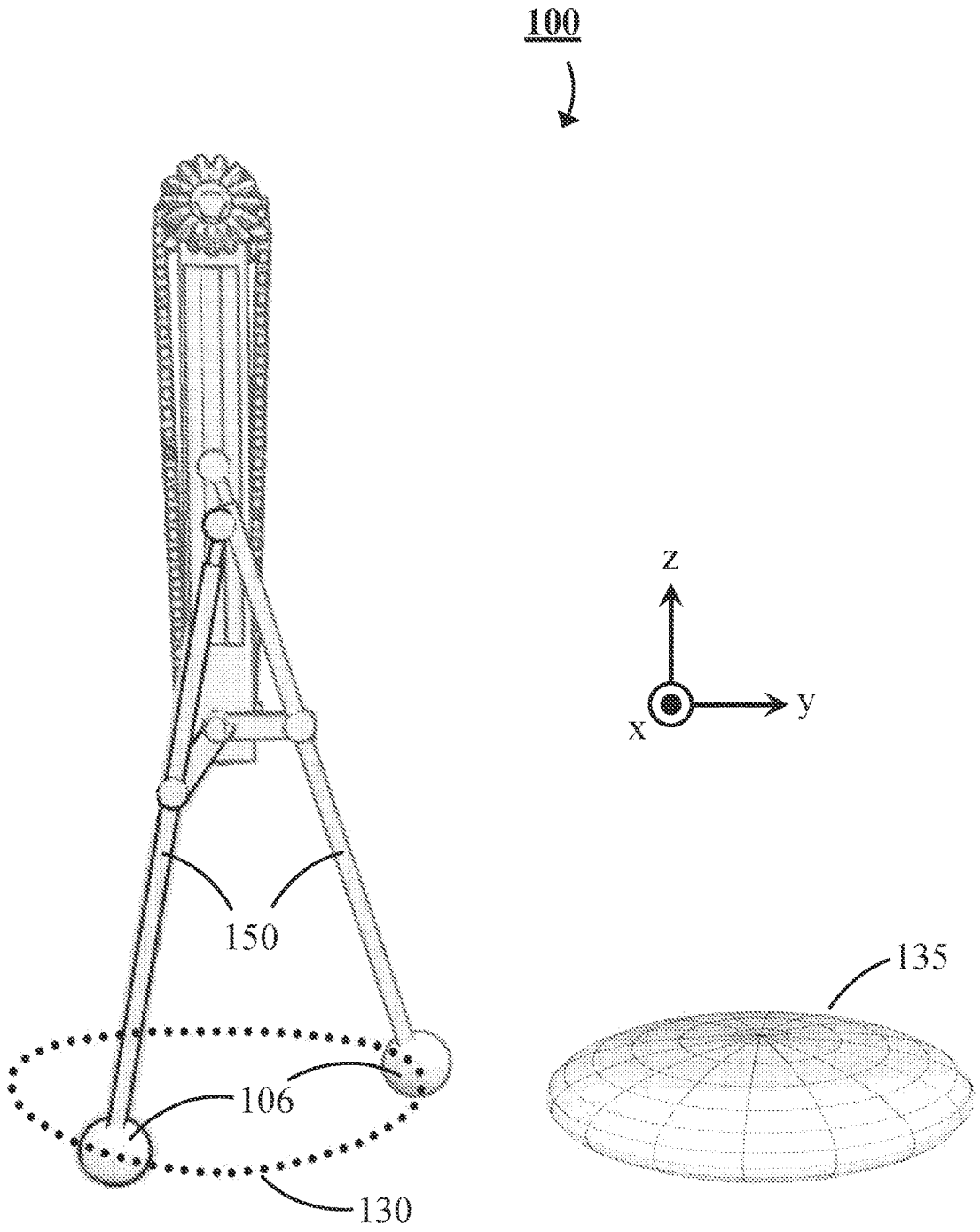
FIG. 4 is a lateral view of positions of a path of a core mechanism according to an embodiment of the invention.

FIG. 4 depicts two possible positions of the rotation of variable length rigid bar 150. Path 130 subtended by ball joint 106 is a flattened ellipse. This is intentionally not a classic conic section formed by rotation of variable length rigid bar 150 and ball joint 106. While a classic elliptical machine rotates in one place subtending a geometric ellipse, the presently described apparatus of the present invention rotates and revolves subtending a three-dimensional flattened oblate ellipsoid 135.

Regarding the core mechanism, "rotation" refers to the rotation of variable length rigid bar 150 caused by rotation of fourth armature 103 and "revolution" refers to the revolution of core armature assembly 100 about the z-axis.

Figure 5:
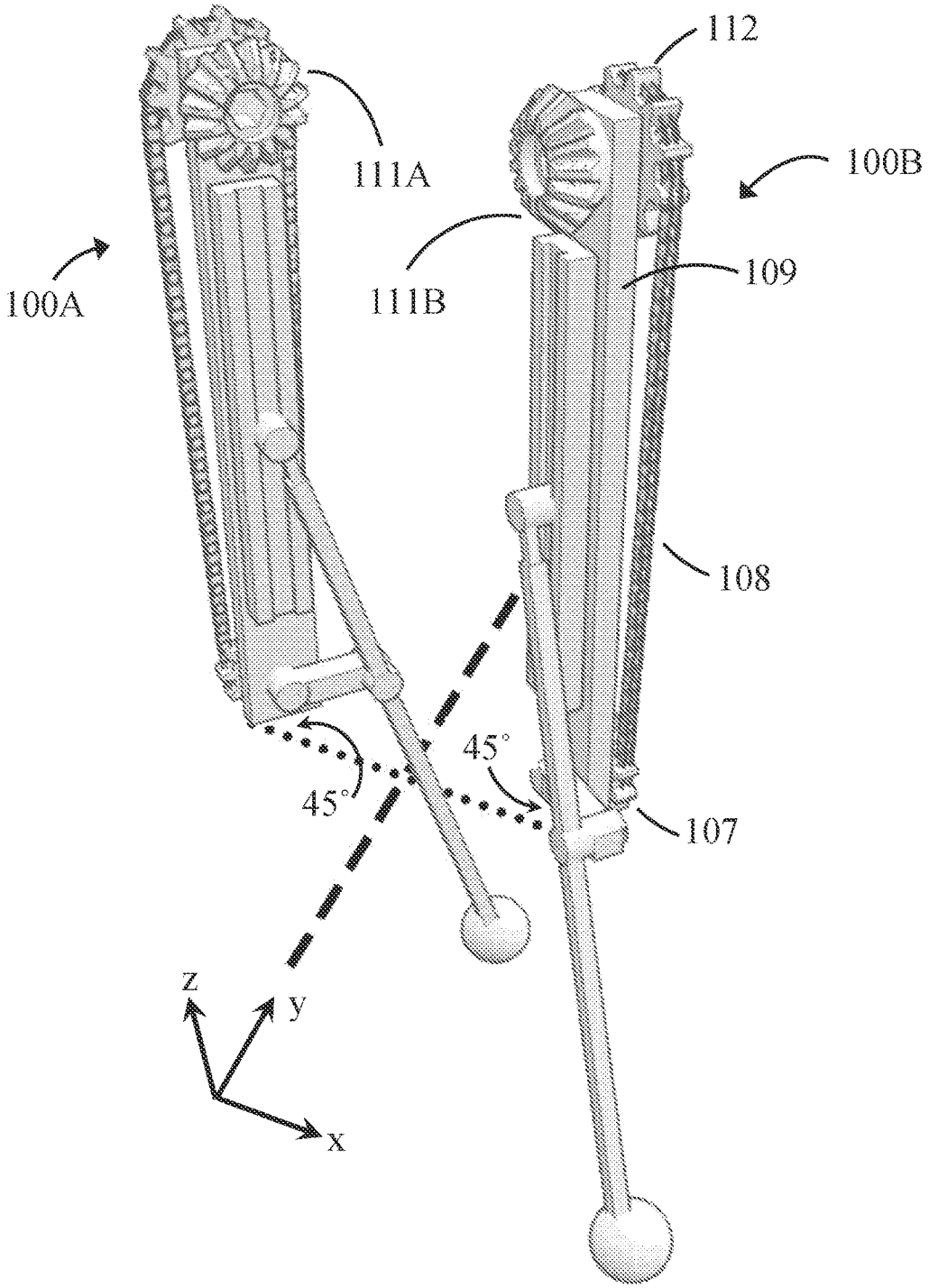
FIG. 5 is a perspective view of a pair of core mechanisms in 45 degree revolution according to an embodiment of the present invention.

In an embodiment, as shown in FIG. 5, rotating and revolving primary path generator 1000 comprises two side-by-side core armature assemblies 100A and 100B, one corresponding to each foot of the user. As the user "peddles", each rotating and revolving primary path generator 1000, the core armature assemblies 100A and 100B rotate in the same direction, 180 degrees out of phase from each other. Each core armature assembly 100A and 100B also revolve about the z-axis (vertical) in phase but in opposite directions from each other. This drives the motion path from the y-z plane toward the x-z plane and then back into the y-z plane and at points in between. As shown in FIG. 5, the pair of core mechanisms 100A and 100B are in partial revolution (45 degrees) between the y-z plane and x-z plane.

As discussed, fourth armature 103 rotation about the z-axis is driven through chain 108 engaged with upper sprocket 112 and lower sprocket 107, with sprockets 112 and 107 mounted on beam 109. First beveled cog 111A and second beveled cog 111B interface with various cogs disposed on drive assembly 200 that comprises drive motor drive shafts as discussed with reference to FIG. 6 below.

Figure 6:
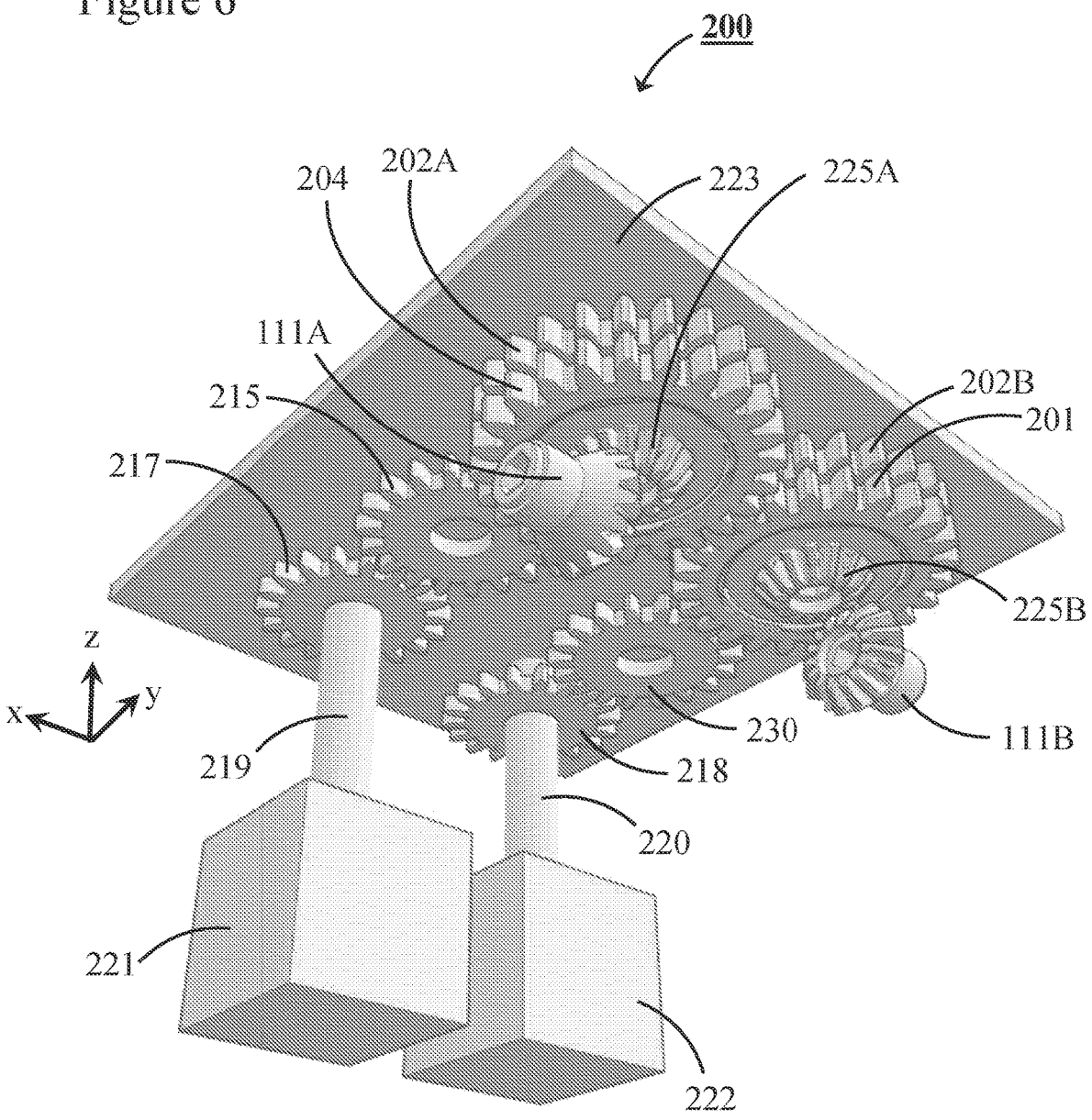
FIG. 6 is a perspective view of a drive mechanism of a core mechanism according to an embodiment of the invention.

FIG. 6 depicts drive assembly 200 that interfaces with core armature assemblies 100A and 100B via first and second beveled cogs 111A and 111B. Drive assembly 200 comprises platform 223 on which several platform cogs are disposed. As shown, first and second beveled cogs 111A and 111B of core armature assemblies 100A and 100B interface with third beveled cog 225A and fourth beveled cog 225B disposed on the undersides of first double cog 202A and second double cog 202B, respectively. Also disposed on platform 223 are first motor drive shaft 219 and second motor drive shaft 220. Motor drive shafts 219 and 220 are shortened for illustrative purposes. Disposed on a distal end of each of the drive shafts is first motor 221 and second motor 222. Motor 221 drives rotation of the core armatures and motor 222 drives revolution of the core armatures.

Regarding rotation of core armature assemblies 100A and 100B, from the perspective of the user on the machine, first motor 221 rotates corresponding first drive shaft 219, rotating corresponding first cog, 217, that in turn rotates third cog

215, that rotates first double cog 202A, that in turn rotates third beveled cog 225A, that in turn rotates first beveled cog 111A, which drives rotation of the first core armature assembly 100A. Rotating cog 202A also drives rotating cog 202B connected to beveled cog 225B driving beveled cog 111B, which drives rotation of the second core armature assembly 100B.

Regarding revolution of core armature assemblies 100A and 100B, from the perspective of the user on the machine, second motor 222 rotates corresponding second drive shaft 220, rotating corresponding second cog, 218, that in turn rotates third cog 230, that rotates cog 201, that in turn rotates cog 204, that in turn revolves the entire 100A apparatus about the z-axis. Rotating cog 201 also drives revolution of the second core armature assembly 100B In an embodiment, first motor 221 is a resistance motor like the one in a standard elliptical unit. These provide graded resistance based on user settings through an electromechanical apparatus. The user drives the unit by pedaling. In an embodiment, second motor 222 is a traditional motor driving revolution of the core mechanisms about the z-axis.

FIG. 7 depicts the components of rectifying assembly 300 according to an embodiment of the invention. The functions of the rectifying assembly are to turn the path subtended by third armature 105 upside down, move the motion away from the central unit, and allow an interface with the amplitude and tilt mechanism.

Third armature 105 of the core armature assemblies 100 is shown, which articulates through ball joint, 106, with proximal rectifying armature 301 that articulates through an elbow joint (not shown) with the central rectifying armature 302, that articulates through an elbow joint (not shown) with the distal rectifying armature 306. Proximal rectifying armature 301 and distal rectifying armature 306 are kept parallel by rectifier chain 305 guided by a first rectifier sprocket 303, central rectifying armature 302, and second rectifier sprocket 304. A pivoting point of rotation secured on central rectifying armature 302 by pivoting joint 501 is adjustable up/down in the z-axis direction, providing down/up tilt of the foot pedals, respectively, and forward/backward in the y-axis direction, providing decreased/increased path amplitude of the foot pedals, respectively.

Figure 8:
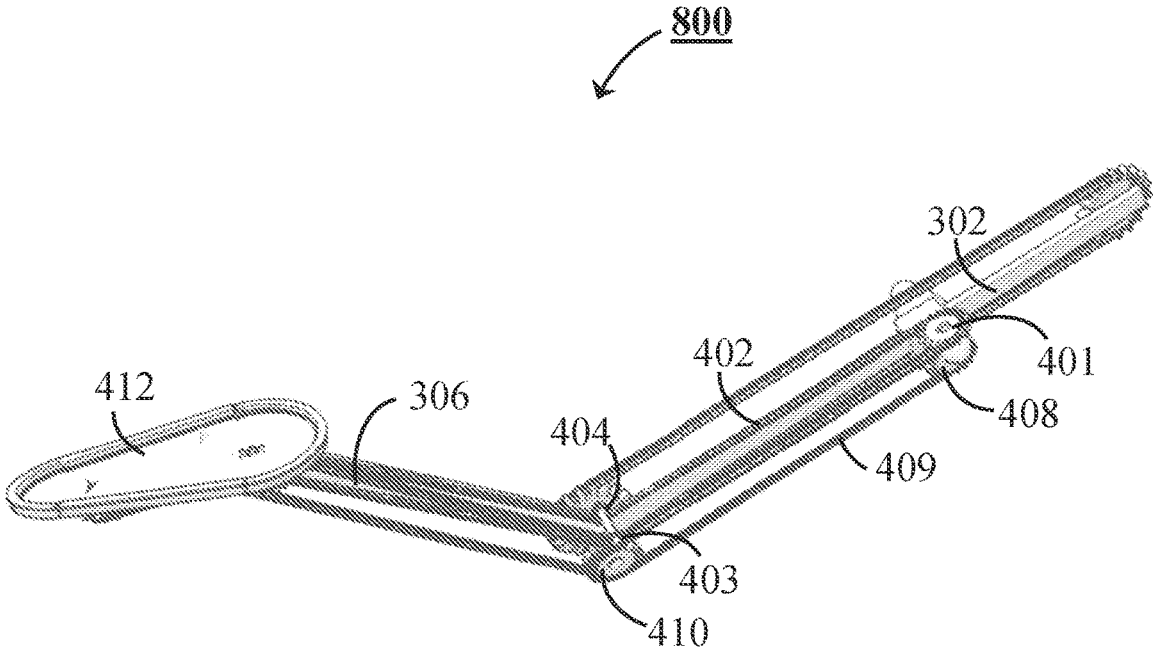
FIG. 8 is a perspective view of a pedal assembly according to an embodiment of the present invention.
Figure 9:
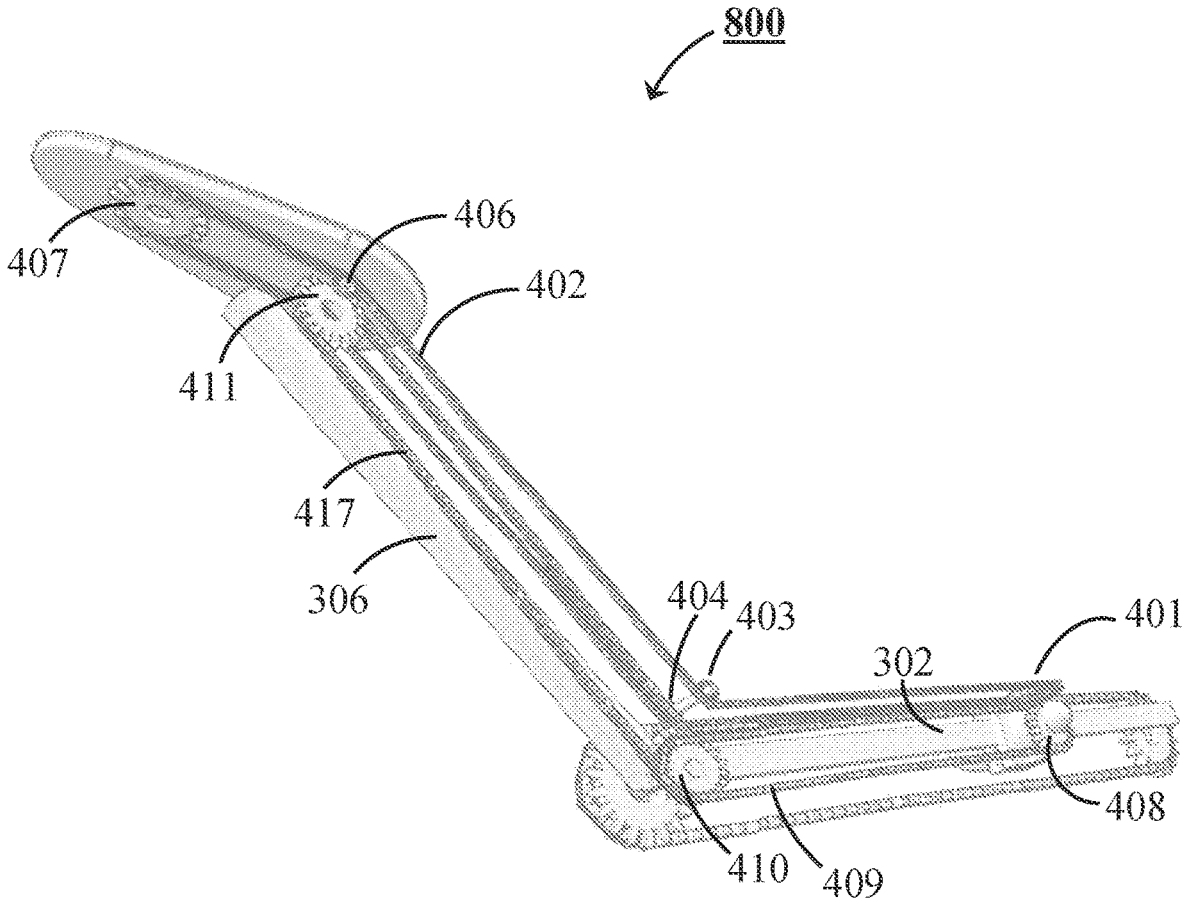
FIG. 9 is a perspective view of a pedal assembly according to an embodiment of the present invention.

FIG. 8 and FIG. 9 offer different views of pedal assembly 800. In FIG. 8, pedal assembly 800 comprises pedal 412 associated with distal rectifying armature 306. In operation, each of the pair of foot pedals 412 (only one shown) are to remain parallel to the ground and parallel to the y-axis. As distal rectifying armature 306 rotates into many planes, two counter processes are employed to account for these rotations.

Keeping the foot pedals perpendicular to the z-plane, parallel to the ground, employs a chain and sprocket balancing system. Proximal sprocket 408 attaches to ball joint 501 where its rotation is fixed. Chain 409 connects sprocket 408 to sprocket 410 which rotates in unison with chain 417 connecting with sprocket 411 which articulates with pedal 412.

A parallel system of chains and sprockets keep the foot pedals in the y-plane. Proximal sprocket 401 attaches to chain 402 extending around small sprockets 403 and 404 then extending around sprockets 406 and a similar sprocket to 406 hidden behind sprocket 411 in FIG. 9. Chain 402 then loops around sprocket 407.

Not shown are straps secured to the foot pedals overlying the front of user's shoes (like toes clips on the pedal of a bicycle) allowing the user to pull up on alternating feet, working additional muscle groups.

Figure 10:
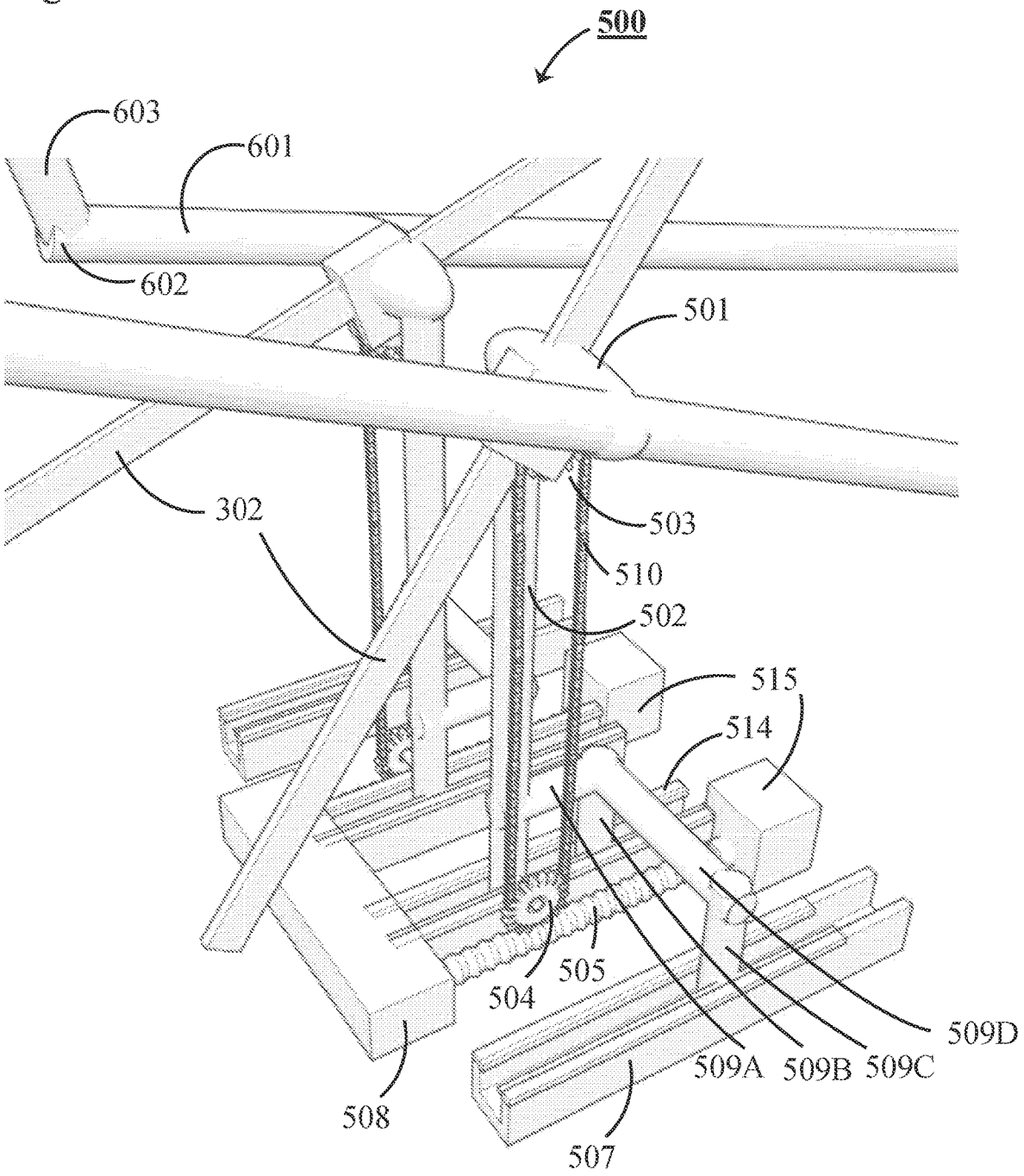
FIG. 10 is a perspective view of a pivoting assembly of a path generator according to an embodiment of the invention.

FIG. 10 demonstrates the amplitude and tilt controller 500. Stride amplitudes of users will vary up/down, so the apparatus allows for this by making the position of pivot point ball joint, 501, and pivot shaft, 502, able to travel in the negative/positive directions along the y-axis, respectively. The pivot shaft 502 connects to a group of stabilizers 509A-D that glide in grooves set in blocks 507 and 514. Motor 508 drives a screw shaft 505 driving pivot shaft up or down the y-axis. 515 are stop blocks.

Stride tilt allowing for "uphill"/"downhill" exercise involves lowering/raising the pivot points, 501, on each side, respectively. The mechanism is simplified here but a sprocket 504 is driven by motor 508. A separate component in motor 508 drives a chain 510 to raise or lower ball joint 501. In the diagram it is shown at its maximum height.

Referring again to FIG. 1, the handlebar exerciser comprises proximal arm 601, elbow joint 602, and distal arm 603 articulating through the ball joint 501. As proximal arm 601 articulates with ball joint 106, and pivots thru ball joint 501, its motion is the opposite of the corresponding pedal. The length of the proximal arm 601, and the angle of the elbow joint 602 are adjustable. The user may also simply hold stationary handlebars set between the moving handlebars (not shown).

This difference in complexity between the presently described exercise machine as compared to a standard elliptical machine is significant.

In one embodiment as shown in FIG. 1 a control panel provides for electronic adjustment resistance, incline, flatness of the elliptical path, amplitude of the forward/backward elliptical path, amplitude of the side-to-side elliptical path, speed and direction of rotation and revolution of the core armature assemblies, the length of the first armature in the core armature assemblies, the radius of rotation of the core armature assemblies, handlebar length and angle, speed of cooling fan, and a start and stop button. Various personal user settings can be edited and saved. The user may also fix the revolution in position yielding one of four motions, forward, backward, lateral clockwise, and lateral counterclockwise.

In one embodiment, as shown in FIG. 1 the control panel includes a display of the settings of the adjustable items described above. The display also displays distance traveled, calories burned, watts generated, net elevation achieved, time completed, time to go, pedal rotations and revolutions, and heart rate.

The control panel includes a clip on the top for an iPad or computer tablet to allow viewing of entertainment, a phone display/charger, water bottle holder, and a shirt clip that automatically stops the machine if it becomes disconnected from the user.

Adjustable elements from the control panel are duplicated on the fixed and moving handlebars. In addition to metallic heart rate sensors on each:

a. On the right: resistance, amplitude of the forward/backward elliptical path, flatness of the elliptical path, handlebar length (on the moving handlebar only)
b. On the left: incline, amplitude of the side-to-side elliptical path, revolution speed, arm bar angle (on the moving handlebars only)

Additional control includes varying revolution speeds. By example, the user may want to spend 80 percent of the time in forward/backward motion and 20 percent in side-to-side motion. The user may want to remain in just forward or lateral motion. The user may desire a flattened ellipse in the forward/backward motion but a more circular motion in the side-to-side motion. Other similar variability is claimed. The control allows for firmware and software upgrades to include new programs driving the device and displaying data.

The above summary is not intended as an exhaustive description of the claimed subject matter but, rather, is intended to provide a brief overview of some of the functionality associated therewith. Other systems, methods, functionality, features and advantages of the claimed subject matter will be or will become apparent to one with skill in the art upon examination of the following figures and detailed description. Although various embodiments of the present disclosure have been illustrated in the accompanying drawings and described in the foregoing Detailed Description, it will be understood that the present system is not limited to the embodiments disclosed, but is capable of numerous rearrangements, modifications, and substitutions without departing from the spirit of the system as set forth and defined herein.

I claim:

1. An exercise apparatus orienting foot pedals and handlebars, comprising a. a first rotating armature, comprising i. a first variable length rod slidably engaged in a first vertical groove to generate a first subtended path of rotation;

ii. a first beveled cog to drive a first rotating armature core;

b. a second rotating armature, comprising i. a second variable length rod slidably engaged in a second vertical groove to generate a second subtended path of rotation;

ii. a second beveled cog to drive a second rotating armature core;

c. a first motor to revolve the first rotating armature in opposite directions and allowing the first subtended path to migrate from a first two-dimensional plane into a second two dimensional plane and back into the first two-dimensional plane;

d. a first rectifying armature that reverses the first subtended path of rotation about a first axis;

e. a second rectifying armature that reverses the second subtended path of rotation about a first axis;

f. a first pedal corresponding to the first rectifying armature and a second pedal corresponding to the second rectifying armature, each having a corresponding supporting pivot zone for simultaneous upward/downward incline and increasing/decreasing amplitude of a path of the first pedal and of a path of the second pedal.

2. The exercise apparatus of claim 1, further comprising:

h. adjustable handlebars that rotate and revolve in opposite and out of phase motion from the first foot pedal and the second foot pedal allowing rotation and revolution of the adjustable handlebars in multiple planes.

3. The exercise apparatus of claim 2, further comprising a control panel for setting and adjustment of a standard parameter of an elliptical machine for the exercise apparatus and a new parameter corresponding to an additional range of motion.

4. The exercise apparatus of claim 3, further comprising display.

5. The exercise apparatus of claim 1, further comprising:

g. at least one cog and at least one sprocket that maintain a horizontal tilt and parallel orientation in a first direction of the first foot pedal and the second foot pedal.

6. The exercise apparatus of claim 1, wherein the first subtended path of rotation comprises a substantially flattened elliptical path.

7. The exercise apparatus of claim 1, wherein the exercise apparatus is a standing exercise apparatus.

* * * * *